US007112742B2

(12) United States Patent
Yoshimatsu

(10) Patent No.: US 7,112,742 B2
(45) Date of Patent: Sep. 26, 2006

(54) METHOD OF IMPROVING INTERIOR ENVIRONMENT AND GROUNDING ELECTRODE DEVICE

(75) Inventor: Michiharu Yoshimatsu, Kanagawa (JP)

(73) Assignee: Healthcoat Clearway Co., Ltd., Kanagawa (JP)

( * ) Notice: Subject to any disclaimer, the term of this patent is extended or adjusted under 35 U.S.C. 154(b) by 85 days.

(21) Appl. No.: 10/843,558

(22) Filed: May 12, 2004

(65) Prior Publication Data

US 2004/0206533 A1 Oct. 21, 2004

(51) Int. Cl.
*H01R 4/66* (2006.01)
*H01R 13/03* (2006.01)

(52) U.S. Cl. ..... 174/51; 174/5 R; 174/5 SG; 174/7; 174/6; 361/600

(58) Field of Classification Search ..... 174/5 SG, 174/51, 5 R, 5 SB, 7, 6, 48, 50, 59, 65 R, 174/135, 480, 481.5; 220/3.2, 3.3; 361/600, 361/601, 42, 219; 439/92, 95, 98, 100, 101, 439/108; 528/332
See application file for complete search history.

(56) References Cited

U.S. PATENT DOCUMENTS

| | | | | |
|---|---|---|---|---|
| 4,743,998 | A * | 5/1988 | Wu | 174/6 |
| 4,885,428 | A * | 12/1989 | Roberts | 174/6 |
| 4,993,960 | A * | 2/1991 | Franks, Jr. | 174/6 |
| 6,277,949 | B1 | 8/2001 | Yoshimatsu | |
| 6,747,204 | B1 * | 6/2004 | DeLand | 174/50 |
| 6,965,079 | B1 * | 11/2005 | Westberry | 174/2 |

* cited by examiner

*Primary Examiner*—Angel R. Estrada
(74) *Attorney, Agent, or Firm*—Wenderoth, Lind & Ponack, L.L.P.

(57) ABSTRACT

To maintain an interior environment in an environment in which negative ions are abundant, and to stably maintain the environment at a higher level with maintaining an efficacy of the charcoal included in a paint containing a charcoal powder applied to a wall face in a room, a floor face in the room is formed by an insulator and the wall face is made to have a grounding electric potential by connecting it to a grounding electrode buried in a ground according to a method of the invention. The grounding electrode device includes a main body formed in a bottomed tubular body by a metal, and a charcoal and a catalyst are accommodated in the main body.

3 Claims, 3 Drawing Sheets

METHOD OF IMPROVING INTERIOR ENVIRONMENT AND GROUNDING ELECTRODE DEVICE

BACKGROUND OF THE INVENTION

1. Field of the Invention

The present invention relates to a method of improving an environment in the room to an environment in which negative ions are abundant by maintaining an efficacy of the charcoal when a paint containing a charcoal powder has been applied to a wall face in a room, and a grounding electrode device adapted so as to collect the negative ions by accommodating the charcoal therein.

2. Related Art

Hitherto, in a case where a house is newly built or the like, such a pollution of the interior environment has become a problem because, when building the house, a volatile organic compound (VOC) such as holmaldehyde is generated by using a building material, a paint or an adhesive etc., each of which contains petrochemicals.

In the case where the volatile organic compound (VOC) such as holmaldehyde is generated in this manner, it is deemed that there are influences on a human body such as fatigue, headache, vertigo, diffusion of visual field, skin redness, dry skin, throat ache, hoarseness and palpitation, and these symptoms are referred to as so-called sick house syndrome or new construction disease.

As a background of the fact that the sick house syndrome has become frequent, there are enumerated, e.g., an increase in airtightness of the house, spreading of the building material having a high heat insulating property, and the like and the volatile organic compound, such as holmaldehyde, volatilized from the building material and the like is difficult to be discharged from the house to an outside area due the fact that the house is highly airtight, so that there is considered the fact that it is accumulated inside the house.

Further, since the environment in which the volatile organic compound (VOC) such as holmaldehyde is abundantly generated becomes generally an environment in which positive ions exist abundantly, the interior environment generating the sick house syndrome also becomes an environment in which the volatile organic compound such as holmaldehyde exists abundantly and also becomes an environment in which the positive ions exist abundantly.

As a method of improving the environment in which the positive ions exist abundantly in the room to an environment in which negative ions exist abundantly, it is noted to use charcoal.

Since the charcoal is porous, the volatile organic compound such as holmaldehyde is adsorbed to its many pores. Additionally, the fact has been known that the negative ions can be collected by providing the charcoal, so that the interior can be improved to the environment in which the negative ions exist abundantly.

As the paint containing the charcoal, there is a paint composition, in which the charcoal is contained in a high melting point type polyamide resin (hereinafter referred to as "nylon" (trademark) etc. and a solvent of the polyamide resin, by the same applicant (refer to U.S. Pat. No. 6,277,949).

The technique disclosed in U.S. Pat. No. 6,277,949 is one adapted such that properties of the charcoal, i.e., a humidity controlling ability, an antibacterial action, a deodorization action, an air cleaning action and the like contained in the paint composition can be brought about so as not to hinder the properties of the charcoal contained in the paint composition, considering a coating formed by applying the paint composition has an air permeability, a water permeability and a waterproofness.

However, in the publicly-known technique of U.S. Pat. No. 6,277,949, just after the paint composition containing the charcoal has been applied to the wall face and the like in the room, the interior environment can be improved to the environment in which the negative ions exist abundantly by the properties of the charcoal due to the charcoal powder. However, the efficacy of the charcoal is reduced with an elapse of time by the fact that the charcoal powder adsorbs the positive ions together with the volatile organic compound such as holmaldehyde. Thus, there is a problem in that it becomes impossible to maintain the interior environment in a state in which the negative ions exist abundantly.

Accordingly, in the conventional method of improving the interior environment by using the charcoal, there are problems that must be solved in the case where the paint containing the charcoal powder has been applied to the wall face in the room, the efficacy of the charcoal is caused to be maintained to thereby make it possible to maintain the interior environment in the environment in which the negative ions are abundant, and that the environment in which the negative ions are abundant can be stably maintained at a higher level.

SUMMARY OF THE INVENTION

As a concrete means for solving the above problems of the conventional technique, the present invention provides a method of improving an interior environment by applying a paint containing a charcoal powder to a wall face in a room, wherein a floor face in the room is formed by an insulator, and the wall face is made to have a grounding electric potential by connecting the wall face to a grounding electrode buried in a ground.

The method according to the invention includes, as additional requirements, the facts that the grounding electrode is an electrode buried in the ground in a depth of about 1–2 m; that the paint containing the charcoal powder is a paint composition containing a high melting point type nylon resin consisting of nylon 6, nylon 66, nylon 12 and nylon 610, a low melting point type nylon resin consisting of nylon 6, nylon 66 and nylon 12, or a high melting point type nylon resin consisting of nylon 6, nylon 66 and nylon 12, a solvent of these nylons, and the charcoal powder; and that plural wall faces in the room are mutually connected by conductors and, among the conductors, at least one is connected to the grounding electrode.

Further, the invention provides a grounding electrode device comprising a main body formed in a bottomed tubular body by at least a metal, and a charcoal and a catalyst accommodated in the earth main body.

The grounding electrode device according to the invention includes, as additional requirements, the facts that a ratio of the catalyst to the charcoal is about 5–30 parts by weight of the catalyst perl 100 parts by weight of charcoal; that the charcoal is a powder whose diameter is about 1–500 μm; that the catalyst is sodium chloride; that the metal is a stainless metal; that it is made to be a hermetically sealed structure by providing a lid member in the grounding electrode main body; and that the lid member is provided with an electrode.

In the method according to the invention, since the floor face becomes an insulated state by providing the insulator on the floor face in the room, it is possible to prevent the negative ions from leaking from the floor face. Further, by the facts that the paint containing the charcoal is applied to the wall face in the room and that the wall face is made to have the grounding electric potential by connecting the wall face to the grounding electrode buried in the ground, the efficacy of the charcoal is maintained by adjusting an electric balance of the charcoal powder, so that it becomes possible to maintain the interior environment in the state in which the negative ions are abundant.

Further, by using, as the grounding electrode, the grounding electrode device in which a mixture of the charcoal and the catalyst is accommodated inside the grounding electrode main body that is the bottomed tubular body made of the metal, the efficacy of the charcoal can be maintained at a high level under a stable state, so that it becomes possible to maintain the interior environment in a state in which the negative ions are more abundant, since the grounding electrode device is one in which the efficacy of the charcoal is easily obtained due to an existence of the catalyst. Further, even in a case where the grounding electrode device is singly used by connecting an antenna to the grounding electrode device, it becomes possible to collect the negative ions around the antenna, so that an environment around the antenna can be made to have the environment in which the negative ions are abundant not only in the interior but also in the outdoors.

DETAILED DESCRIPTION OF PREFERRED EMBODIMENT

Next, the invention is explained in detail on the basis of a concrete implementation mode.

Figure 1:
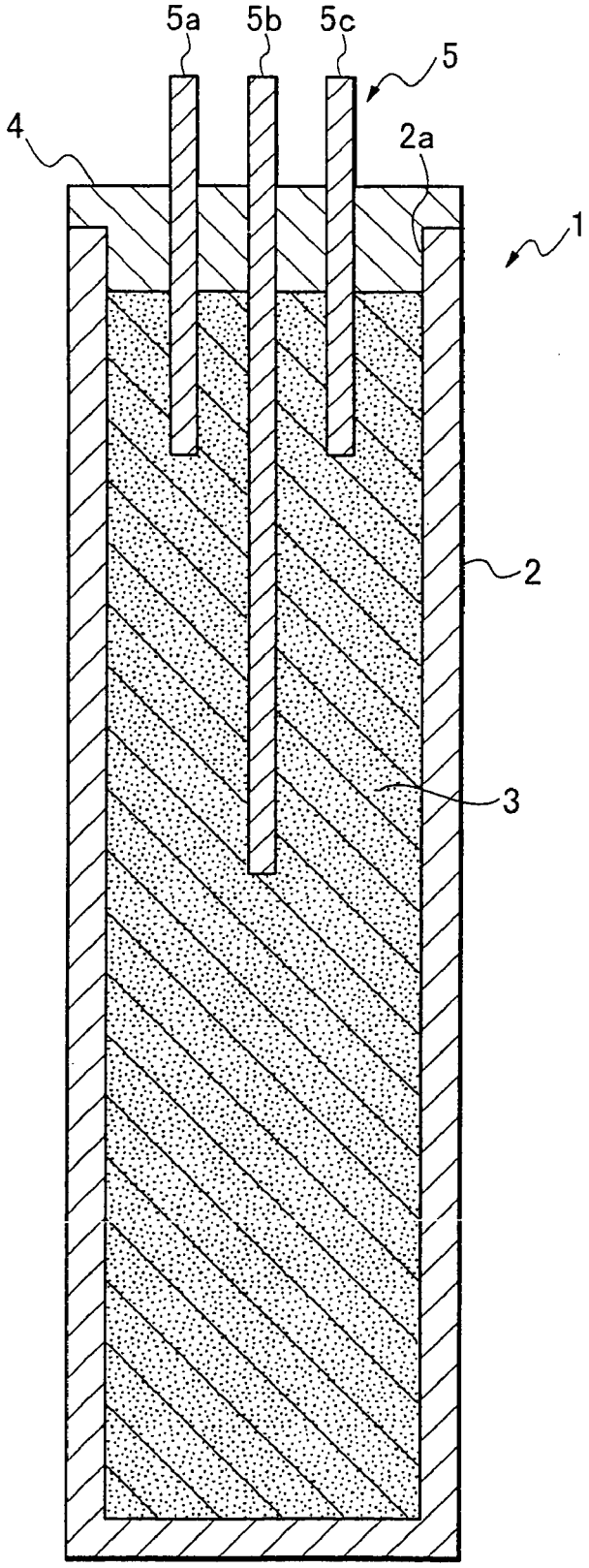
FIG. 1 is a sectional view schematically showing a grounding electrode device of an embodiment according to the invention.

A schematic sectional view of a grounding electrode device according to the implementation mode of the invention is shown in FIG. 1. A main body 2 of a grounding electrode device 1 can be one in which a metal is formed into a bottomed tubular body. As the bottomed tubular body, there may be used for example, one in which the metal is formed in a bottomed tubular shape such as cylindrical shape or polygonal tubular shape.

For the metal, it is preferable to use a metal such as a stainless metal whose corrosion is little. Further, as a size of the grounding electrode main body 2, it is preferable that a length is about 1 m and a diameter is about 0.2–0.3 mm, but it is not limited especially to this.

An opening part 2*a* is formed in an upper part side of the main body 2 of the grounding electrode device 1. At least a charcoal 3 and a catalyst (not shown in the drawing) are mixed and accommodated inside the main body 2 from the opening part 2*a*. For the catalyst, it is possible to use sodium chloride, but it is not limited to this, and any one may be used so long as it is used as an electric catalyst of the charcoal 3. In short, it suffices if it is made possible to effectively and easily obtain the efficacy of the charcoal 3 by mixing the catalyst.

For the charcoal 3, it is possible to use a charcoal such as soft charcoal and hard charcoal, but it is preferable to use a charcoal, such as binchotan charcoal, whose efficacy collecting the negative ions is high. Further, for the charcoal 3, it is possible to use a powder whose diameter is about 1–500 μm, and it is preferable to use a powder whose diameter is about 1–20 μm.

For a ratio of mixing the charcoal 3 and the catalyst to be accommodated inside the main body 2, it suffices if the ratio is 100 parts by weight of charcoal 3 per 5–30 parts by weight of the catalyst. Preferably, the ratio is 100 parts by weight of charcoal 3 per about 10 parts by weight of the catalyst. For example, in a case where a size of the main body 2 is about 1 m in length and about 0.2 m in diameter, it suffices if the charcoal 3 is about 18 kg and the catalyst about 2 kg.

After at least the charcoal 3 and the catalyst have been mixed and accommodated inside the main body 2 of the grounding electrode device 1, the opening part 2*a* formed in the upper side of the main body 2 is lidded by providing a lid member 4.

By lidding the opening part 2*a* of the main body 2 by providing the lid member 4, the grounding electrode device 1 can be hermetically sealed and, even in a case where the grounding electrode device 1 is buried in the ground, no foreign matter enters inside the grounding electrode device 1, so that a reaction between the charcoal 3 and the catalyst which have been accommodated inside the grounding electrode device 1 is smoothly performed.

As this lid member 4, it is preferable to use the same quality metal as the main body 2, e.g., a stainless metal, but a synthetic resin and the like may be used. In other words, it suffices if the grounding electrode device 1 can produce a hermetically sealed state by lidding the opening part 2*a* of the main body 2.

The lid member 4 is provided with a connecting electrode 5 in order to facilitate a connection to a conductor (not shown), such as electric wire or earth wire, to be connected to the grounding electrode device 1. In FIG. 1, there is shown an example in which three connecting electrodes 5*a*, 5*b*, 5*c* are provided.

It suffices if end parts of the connecting electrodes 5*a*, 5*b*, 5*c* in an inside side of the main body 2 contact with the charcoal 3 and the catalyst accommodated inside the main body 2. However, in FIG. 1, although the connecting electrodes 5*a*, 5*c* are in a state in which they are inserted in the upper side of the main body 2, the connecting electrode 5*b* is in a state of being inserted to an approximately central part of the main body 2.

By providing the connecting electrodes 5*a*, 5*b*, 5*c* in the lid member 4 of the grounding electrode device 1 in this manner, it is possible to easily take out the efficacy of the charcoal 3 accommodated inside the main body 2.

When burying the grounding electrode device 1 in the ground, in a case where the length of the grounding electrode device 1 is about 1 m, it suffices if a depth of bore is about 1–2 m in view of workability and the like. In short, since it suffices if the main body 2 of the grounding electrode device 1 is buried in the ground, it suffices if the depth is suitably adjusted in dependence on burying conditions and the like.

By only burying the grounding electrode device 1 in the ground in this manner, it is possible to collect the negative ions in a predetermined range around the grounding electrode device 1. Namely, it is possible to obtain the environment in which the negative ions exist abundantly.

By way of parenthesis, in the case where the grounding electrode device 1 is buried in the ground, the efficacy of collecting the negative ions obtained from the grounding electrode device 1 is highest in the central part of the grounding electrode device 1 and secondly high in a lower side of the grounding electrode device 1, and the efficacy obtained in a lower side of the grounding electrode device 1 is slightly lower than the central part and the lower side. However, since the charcoal 3 and the catalyst are mixed and accommodated in the grounding electrode device 1 and the efficacy of collecting the negative ions obtained from the grounding electrode device 1 is higher than a case where the charcoal exists singly, even if only the connecting electrodes 5*a*, 5*c* are inserted in the upper side of the grounding electrode device 1, where the efficacy is slightly lower, it is possible to substantially and sufficiently obtain the efficacy of the charcoal. Accordingly, in a case where it is necessary to obtain a higher efficacy, it suffices if the connecting electrode is inserted to the approximately central part of the main body 2 like the connecting electrode 5*b*, or the connecting electrode is provided in the approximately central part of the main body 2 or in the lower side of the main body 2.

Figure 2:
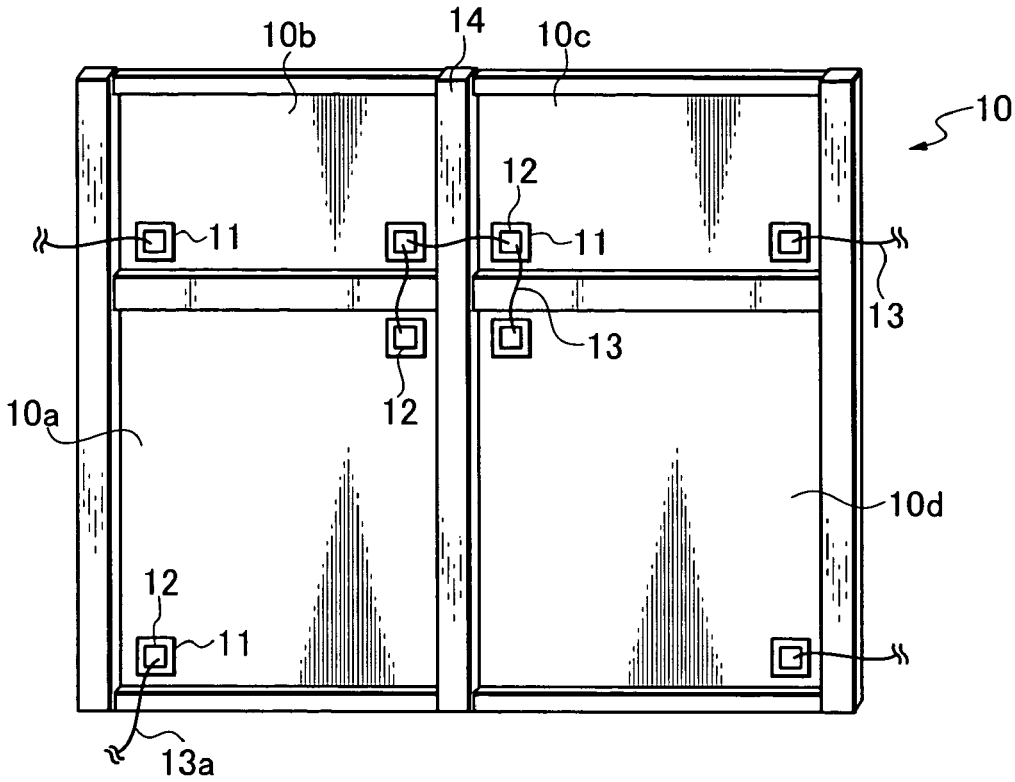
FIG. 2 is an explanatory view showing a state that conductors are connected to a wall face in a room, for explaining the embodiment 1 in a case where the grounding electrode device is used.
Figure 3:
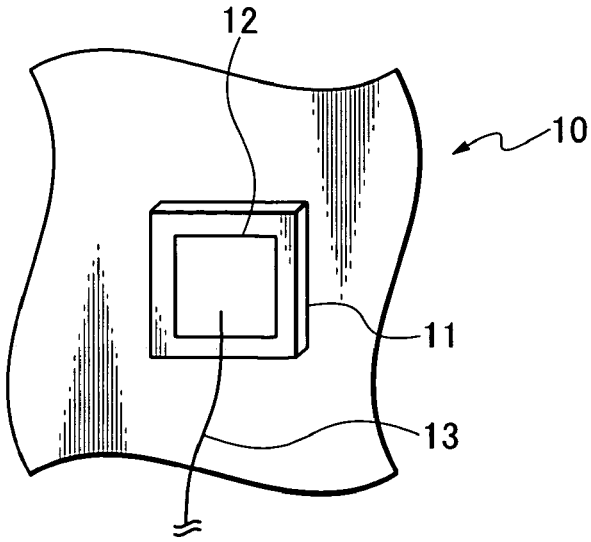
FIG. 3 is an explanatory view showing an enlarged portion of one part of the wall face of FIG. 2.

An embodiment 1 in which the grounding electrode device 1 of the aforesaid implementation mode has been used is explained by using FIG. 2 and FIG. 3. Incidentally, FIG. 2 shows a wall face in a room, and FIG. 3 shows one enlarged part of the wall face.

Embodiment 1

In this embodiment 1, there is shown a method of improving the interior environment to the environment in which the negative ions are abundant. The paint containing the charcoal powder is applied to a wall face 10 in the room. As to the wall face 10 to which the paint containing the charcoal powder has been applied, it suffices if at least one wall face 10 exists.

For the paint containing the charcoal powder, any one may be used so long as it is a paint containing the charcoal. However, especially, it is preferable to use Health Coat (trademark: manufactured by Artec Kobo Co., Ltd.) which is the paint disclosed in the U.S. Pat. No. 6,277,949 and is a paint composition containing a high melting point type nylon resin consisting of nylon 6, nylon 66, nylon 12 and nylon 610, a low melting point type nylon resin consisting of nylon 6, nylon 66 and nylon 12, or a high melting point type nylon resin consisting of nylon 6, nylon 66 and nylon 12, a solvent of these nylons, and a charcoal powder; and the like.

For the charcoal powder, it is possible to use one in which the charcoal, such as hard charcoal or soft charcoal, has been made into a powdery form, but any one kind of the hard charcoal or the soft charcoal can be used, or they can be used while being suitably mixed.

A conductor 13 such as electric wire is connected to the wall face 10 through a sheet of plywood 11 to which the paint containing the charcoal powder has been applied and a copper plate 12. Incidentally, the plywood 11 to which the paint containing the charcoal powder has been applied and the copper plate 12 are components used for facilitating the connection of the conductor 13 to the wall face 10, and are not components which must be necessarily used. For example, in a case where the conductor 13 can be directly connected to the wall face 10, the conductor 13 may be directly connected to the wall face 10 without going through the plywood 11 to which the paint containing the charcoal powder has been applied and the copper plate 12.

Among the conductors 13, at least one conductor 13*a* is connected to a grounding electrode (not shown) buried in the ground. As to a place where the grounding electrode is buried in the ground, it may be any place so long as it is a place such as in a construction site where the grounding electrode can be suitably grounded. However, it is preferable to bury it below a floor of the house concerned because a length of the conductor 13 connected to the grounding electrode can be shortened.

For the grounding electrode, it is preferable to use the grounding electrode device 1 of the aforesaid implementation mode, but it may be any grounding electrode such as metal plate and charcoal plate. This charcoal plate is not limited to a plate-like charcoal, and it may be a rod-like or powdery charcoal.

Further, as shown in FIG. 2, in a case where the wall face 10 is divided into plural wall faces by posts 14 and the like, it suffices if plural wall faces 10*a*, 10*b*, 10*c*, 10*d* are mutually connected by the conductors 13. Additionally, the paint containing the charcoal may be of course applied to all of wall faces 10, including those not shown, in all sides in the room, and the plural wall faces may be mutually connected by the conductors.

Also in this case, in order to facilitate the connection of the conductors 13 to the wall faces 10, the conductors 13 such as electric wires may be connected through the plywood 11 to which the paint containing the charcoal powder has been applied and the copper plate 12, and it suffices if, among the conductors 13, at least one conductor 13*a* is connected to the grounding electrode buried in the ground.

In short, by connecting at least one conductor 13*a* to the grounding electrode buried in the ground and connecting the conductor 13*a* to the wall face 10*a*, the wall face 10*a* can be made to have approximately the same electric potential as the grounding electrode buried in the ground, i.e., the wall face 10*a* can be made to have the grounding electric potential. Further, by mutually connecting the wall faces 10*a*, 10*b*, 10*c*, 10*d* by the conductors 13, all the wall faces 10 can be made to have the grounding electric potential.

By applying the paint containing the charcoal powder to the wall face 10 in this manner, the efficacy of the charcoal can be obtained. And, as mentioned before, the electric balance of the charcoal powder is adjusted to the grounding electric potential by the fact that all the wall faces 10 are made to have the grounding electric potential, and accordingly it becomes possible to maintain the efficacy of the charcoal even if a long time has elapsed.

Further, in this embodiment 1, a floor face in the room is formed by an insulator (not shown). As this insulator, it is possible to use synthetic resin plate and the like. Incidentally, in the invention, it is included not only to form the entire floor face in the room by the insulator but also to provide the insulator, such as sheet made of rubber or synthetic resin plate, on the floor face.

By providing the insulator on the floor face in the room in this manner, the floor face becomes the insulated state, and accordingly it is possible to prevent the negative ions from leaking from the floor face. Additionally, by applying the paint containing charcoal powder to the wall face 10 in the room and connecting the wall face 10 to the grounding electrode buried in the ground to make the wall face 10 have the grounding electric potential, the electric balance of the charcoal powder is adjusted and the efficacy of the charcoal is maintained. Accordingly, the interior environment can be maintained in the environment in which the negative ions exist abundantly and further, the volatile organic compound (VOC) such as holmaldehyde can be absorbed.

For this reason, as the grounding electrode used in this embodiment 1, it suffices if the wall face 10 can be made to have the grounding electric potential. Accordingly, any grounding electrode such as a metal plate or charcoal plate may be used. However, it is preferable to use the grounding electrode device 1 as the grounding electrode, since the grounding electrode device 1 is facilitated to obtain the efficacy of the charcoal 3 by the existence of the catalyst and it can maintain the efficacy of the charcoal 3 at the high level under the stable state, so that it becomes possible to maintain the interior environment in which the negative ions exist more abundantly.

It suffices if the depth for burying the grounding electrode in the ground is about 1–2 m in the ground. In the case where the grounding electrode device 1 is used as the grounding electrode, it suffices if at least the main body 2 of the grounding electrode device 1 is buried.

Further, in a case where the general grounding electrode such as metal plate or charcoal plate is merely used, when a quantity of the water contained in the ground in which the grounding electrode has been buried is increased by a rainfall or a thaw and the like, there is the fact that the electric potential in the room is increased, i.e., the negative ions are reduced. Especially, in a case where the powdery charcoal is buried in the ground as it is and used as the grounding electrode, there is the fact that the efficacy collecting the negative ions by the charcoal powder is extremely reduced by the quantity of the water contained in the ground, since there is the fact that a state in which the water excessively exists between charcoal powder particles is generated. However, in the case where the grounding electrode device 1 is used, the interior environment can be maintained in which the negative ions are abundant even in the case of the rainfall or the thaw, since the efficacy of the charcoal 3 can be maintained at the high level under the stable state.

Embodiment 2

Figure 4:
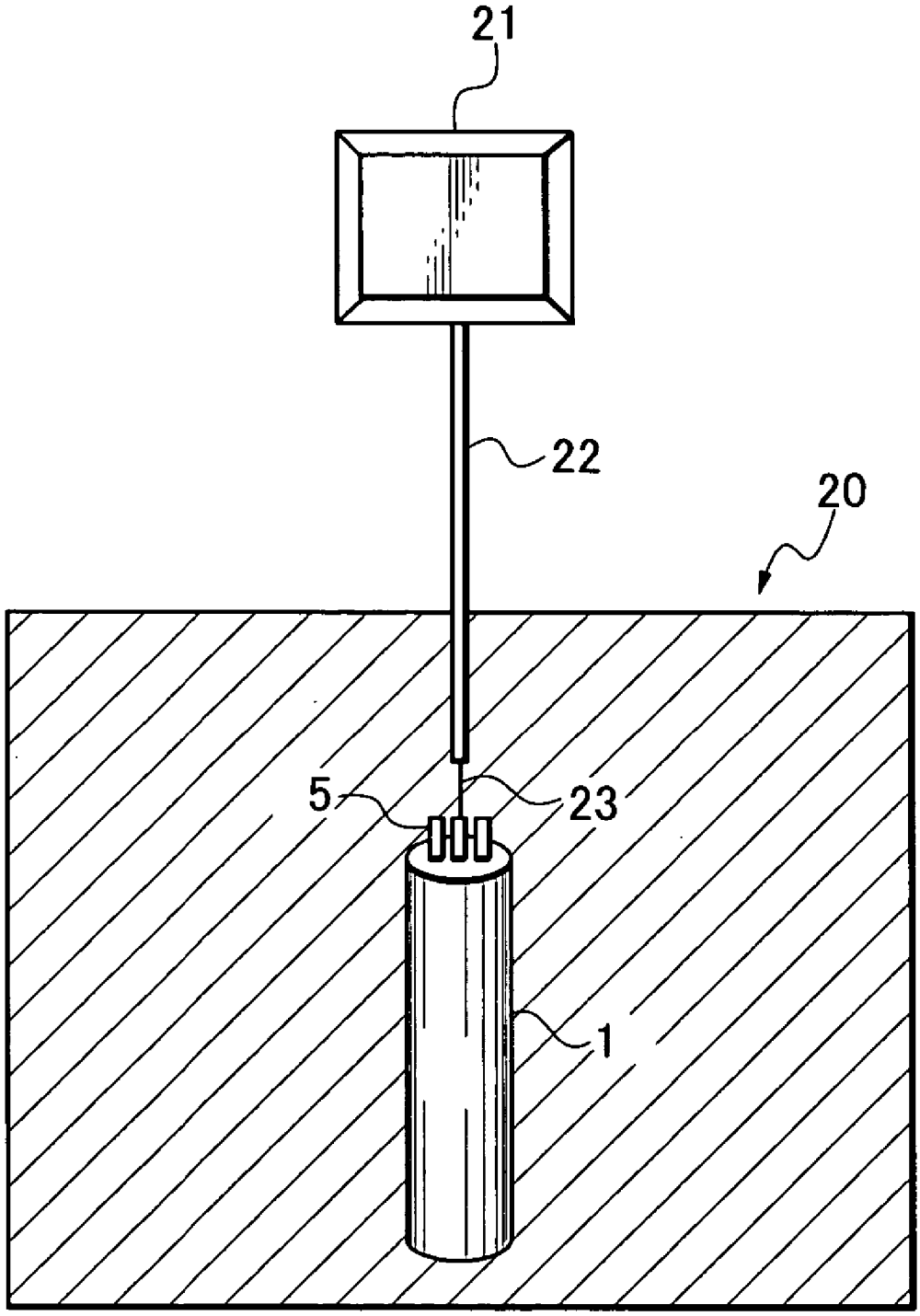
FIG. 4 is an explanatory view showing a state that an antenna is connected to the grounding electrode device buried in a ground in the embodiment 2 in a case where the grounding electrode device of FIG. 1 is used.

Next, an embodiment 2 is explained referring to FIG. 4, in which the grounding electrode device 1 of the aforesaid implementation mode has been used. Incidentally, FIG. 4 shows a state that the grounding electrode device 1 is buried in a ground 20, and an antenna 21 is connected to the grounding electrode device 1.

In this embodiment 2, there is shown a method of improving an outdoor environment such as garden or farm to the environment in which the negative ions are abundant. A rod 22 of the antenna 21 is connected to the connecting electrode 5 of the grounding electrode device 1 buried in the ground 20 through a conductor 23 such as electric wire.

As a place where the antenna 21 is provided, it is preferable to be provided near the grounding electrode device 1, but it may be provided in a place separated by a predetermined distance from the grounding electrode device 1.

By providing the antenna 21 connected to the grounding electrode device 1 in the outdoors such as a garden or farm in this manner, the negative ions can be collected in a predetermined range around the antenna 21.

Therefore, in order to improve a wide range of the outdoor environment such as a farm, it suffices to provide the plural antennas 21 connected to the grounding electrode devices 1. In this occasion, the antennas 21 of a predetermined number may be connected to one grounding electrode device 1.

Incidentally, it is of course that the antenna 21 connected to the grounding electrode device 1 may be provided in the room, thereby improving the interior environment by the antenna 21.

As explained above, the invention is the method of improving the interior environment by applying the paint containing the charcoal powder to the wall face in the room, and brings about excellent advantages that the efficacy of the charcoal is maintained by adjusting the electric balance of the charcoal powder to thereby collect the negative ions in the room, and that the interior environment can be maintained in the environment in which the negative ions are abundant by preventing the negative ions from leaking from the floor face.

Further, since the grounding electrode device according to the invention can efficiently obtain the efficacy of the charcoal due to the existence of the catalyst by the fact that it comprises the main body formed in the bottomed tubular body by at least the metal, and the charcoal and the catalyst which are accommodated inside the main body, it becomes possible to obtain the efficacy of the charcoal at the high level under the stable state, so that it brings about excellent advantages that the environment in which the negative ions are abundant can be stably maintained at the high level, and that the volatile organic compound such as holmaldehyde can be absorbed.

Accordingly, in the case where the grounding electrode device according to the invention is used as the grounding electrode used in the method according to the invention, it becomes possible to improve the interior environment to the environment in which the negative ions exist more abundantly. Further, even in the case where the grounding electrode device is singly used by connecting the antenna to the grounding electrode device, it becomes possible to collect the negative ions around the antenna, so that the environment around the antenna can be made the environment in which the negative ions are abundant not only in the interior but also in the outdoors.

What is claimed is:

1. A method of improving an interior environment, comprising:

applying a paint containing a charcoal powder to a plurality of wall faces in a room to result in a plurality of charcoal powder paint-coated wall faces, the room having a floor face formed by an insulator;

electrically interconnecting plural wall faces of the plurality of charcoal powder paint-coated wall faces via conductors; and connecting at least one of said plural wall faces of the plurality of charcoal powder paint-coated wall faces to a grounding electrode buried in a ground such that each of said plural wall faces of the plurality of charcoal powder paint-coated wall faces is made to have an electric potential that is the same as an electric potential of the grounding electrode.

2. A method according to claim 1, wherein the grounding electrode is buried in the ground at a depth of about 1–2 m.

3. A method according to claim 1, wherein the paint containing a charcoal powder is a paint composition containing: a high melting point type nylon resin consisting of nylon 6, nylon 66, nylon 12 and nylon 610, a low melting point type nylon resin consisting of nylon 6, nylon 66 and nylon 12, or a high melting point type nylon resin consisting of nylon 6, nylon 66 and nylon 12; a solvent; and the charcoal powder.

* * * * *